United States Patent [19]

Manley

[11] Patent Number: 4,498,385

[45] Date of Patent: Feb. 12, 1985

[54] CAN CRUSHER

[76] Inventor: Norman G. Manley, 15809 Booth Cir., Volente, Tex. 78641

[21] Appl. No.: 410,362

[22] Filed: Aug. 23, 1982

[51] Int. Cl.[3] ..... B30B 7/00

[52] U.S. Cl. ..... 100/233; 100/258 A; 100/280; 100/293; 100/902

[58] Field of Search ..... 100/293, 902, 233, 238, 100/258 A, 280, 293; 16/126; D8/88, DIG. 1; 403/355, DIG. 4

[56] References Cited

U.S. PATENT DOCUMENTS

| | | | |
|---|---|---|---|
| 984,649 | 2/1911 | Dafoe | 100/293 |
| 1,514,761 | 11/1924 | Glanschnig | 100/293 X |
| 2,306,473 | 12/1942 | Strobridge | 100/233 X |
| 2,488,912 | 11/1949 | Hitchcock | 100/293 X |
| 2,701,114 | 2/1955 | Donaldson | 16/126 |
| 3,009,414 | 11/1961 | Griemert | 100/293 |
| 3,559,779 | 2/1971 | Lautin | 16/126 X |
| 4,197,796 | 4/1980 | Salatka | 100/902 X |
| 4,290,354 | 9/1981 | Stevens | 100/293 X |
| 4,301,722 | 11/1981 | Balbo et al. | 100/902 X |

*Primary Examiner*—Billy J. Wilhite
*Assistant Examiner*—Christine A. Peterson

[57] ABSTRACT

A can crusher includes a base, a handle pivoted to the base, crusher plates pivoted to the base and handle, and guide means to maintain the plates parallel. The crusher is made of slightly flexible plastics material, is assembled by snapping it together without separate fasteners, and is hollowed out for lightness and strengthened and rigidified with strategically placed ribs.

12 Claims, 9 Drawing Figures

CAN CRUSHER

SUMMARY OF INVENTION

This invention relates to crushing devices and more particularly to a device for crushing cans.

Heretofore hinged second class lever types of crushers have been employed for a variety of purposes. One device of this type is the nut cracker, in which the pivotally connected members between which the nut is placed are both moved toward each other and the angle between the approaching faces of the members between which the nut is placed varies as the nut is cracked. The angular distance travelled by the members between initial contact with the nut and cracking of the nut is small, only a few degrees, i.e. 15 degrees or less.

Another known form of hinged second class lever types of crusher is the orange squeezer. In one known orange squeezer, only one of the cracking members is free to move, the other being provided by a base which rests on the kitchen counter. The moving member or handle of the orange squeezer may move through a considerable angle when an orange is squeezed, i.e. 15 degrees to ninety degrees. As the handle moves from initial to final position, the approaching faces of the crusher between which the orange is squeezed may move from a position in which the faces are perpendicular to each other to one in which they are nearly coplanar.

According to the present invention there is provided a crusher of the hinged second class lever type wherein one member, i.e. the base, is fixed, and the other member, i.e. the handle, is movable, and which is most suitable for crushing cans in that the approaching crusher faces between which the can is crushed are positively maintained parallel to each other during the crushing action, whereby a can may be placed in the crusher with its ends lying flat against the crusher faces and the crusher faces remain flat against the ends of the can throughout the crushing action, applying a force axially of the can to collapse the can by buckling of its sides as in an accordian. The result is to reduce the can volume by about 75%. This is a very useful device for persons collecting used aluminum cans for recycling, since it greatly reduces the volume of material to be shipped to the recycling plant.

A further feature of the invention is that the crusher is made of plastics material and the parts of the crusher are adapted for manufacture by molding, thereby making it very inexpensive.

Other features and advantages of the invention will appear from the following description of a preferred embodiment thereof.

BRIEF DESCRIPTION OF THE DRAWINGS

For a detailed description of a preferred embodiment of the invention reference will be made to the accompanying drawings wherein.

DETAILED DESCRIPTION OF PREFERRED EMBODIMENT

Figures 1, 2, 3, 4, 5, 6, 7, 8, 9:
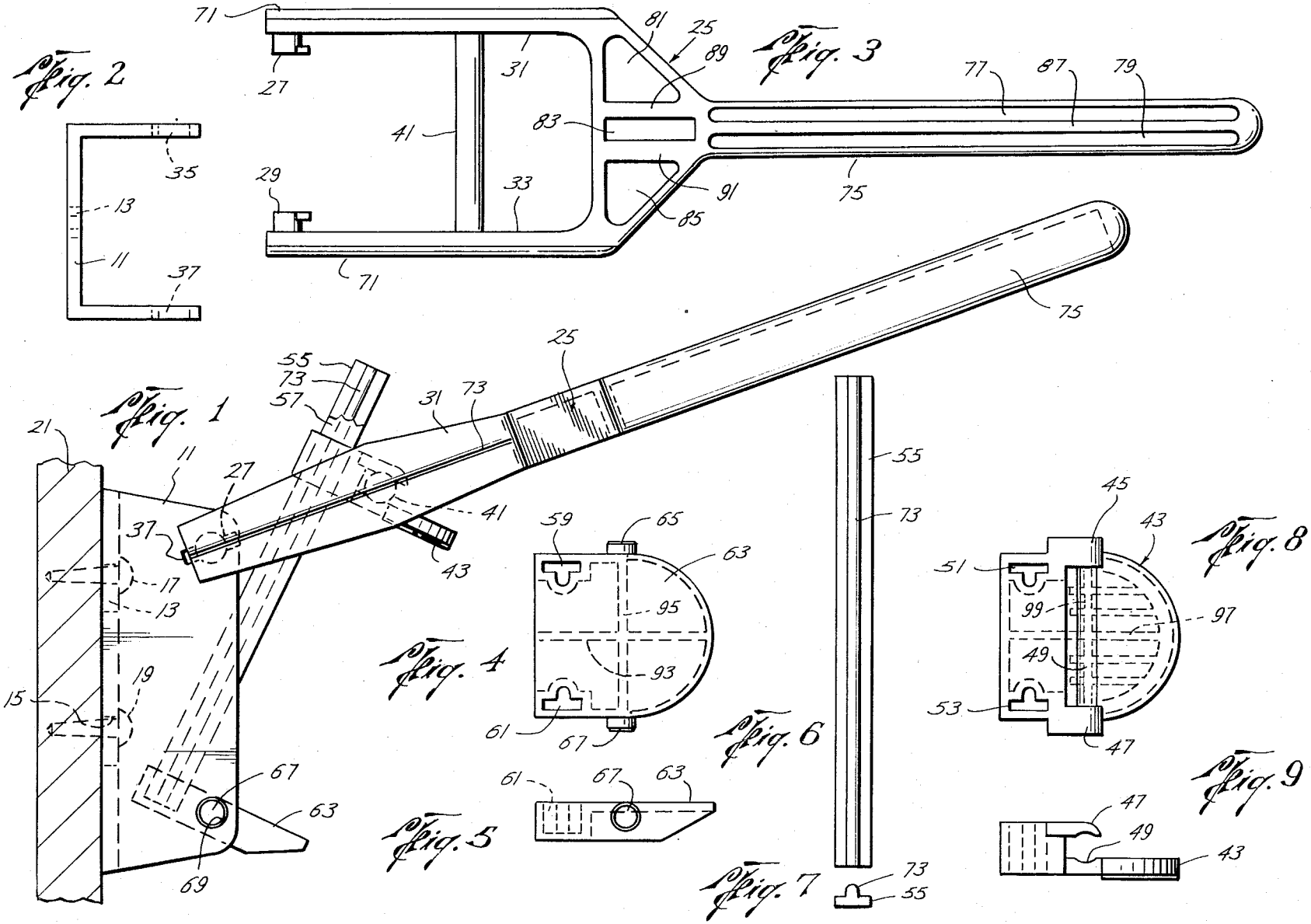
FIG. 1 is a side elevation of a crusher embodying the invention.
FIG. 2 is a top view of the base of the device.
FIG. 3 is a bottom view of the handle.
FIGS. 4 and 5 are plan and side views of the lower crusher face.
FIGS. 6 and 7 are side and end views of one of the guide rails.
FIGS. 8 and 9 are plan and side views of the upper crusher face.

Referring now to the drawings the crusher comprises a channel shaped base 11 having a pair of inverted keyholes 13, 15 in the central plate of the channel, whereby the base can be slipped over a pair of screws 17, 19 releasably supporting the base on wall 21.

A fork shaped handle 25 has a pair of key section pins 27, 29 on the inner edges of its tines 31, 33, by means of which the handle is pivotally connected to the base.

Pins 27, 29, are adapted to enter key shaped holes 35, 37 in the base, the parts being sufficiently flexible to allow such assembly with the keys' shapes in register. Once the handle has been turned to the position shown in FIG. 1, it is locked to the base by the radial projection of the keys.

Handle 25 includes a shaft 41 on which is pivotally mounted upper crusher plate 43 which has fingers 45, 47 which snap over the shaft. The undersides of the fingers and the upper side of the plate are recessed to form a bearing 49 as shown in FIG. 9.

A pair of slots 51, 53 in plate 43 slidably receive a pair of guide rails 55, 57. The slots are of Tee section conforming to the Tee section of the rails.

The lower ends of rails 55, 57, are pressed fitted in Tee shaped sockets 59, 61 in lower crusher plate 63. Plate 63 has a pair of outwardly extending pins 65, 67 which extend into aligned holes 69 at opposite sides of the base; only one of the holes is visible in FIG. 1. Pins 65, 67 are rotatable in holes 69. They are initially snapped into base 11 by springing apart the lower parts of the sides of the base; this is preferably done before the handle is attached by springing together the upper parts of the sides of the base to assemble the handle, and is preferably done after the two guide rails have been pressed into sockets 59, 61. Thereafter upper plate 43 may be slipped over the guide rails and snapped onto shaft 41, thereby completing the assembly without the employment of any screws, bolts and nuts, snap rings, cotter pins, or other separate fasteners and without the use of any cement or glue or other adhesive.

The crusher is preferably made of strong, somewhat flexible plastics material, e.g. a themosetting material such as a phenol formaldeyde condensation product, or a thermoplastic material such as collulose acetate butyrate (Tenite-Butyrate) or, preferably, a superpolyamide (Nylon) reinforced with glass fibers may be used and the parts injection molded. To provide rigidity and strength and light weight, the tines of the handle are provided with ribs 71; similarly rails 55, 57, have ribs 73, and the undersides of the hand grip portion 75 of the handle and the part adjacent thereto are hollowed out at 77, 79, 81, 83, 85, but provided with ribs 87, 89, 91, lower crusher plate is hollowed out on its underside leaving ribs 93, 95, and upper crusher plate 43 is hollowed out on its underside leaving a pattern of parallel ribs 97 and cross ribs 99.

In operation, a can is placed with its ends adjacent the inner faces of the crusher plates and handle 25 is lowered bringing the crusher plates closer together. As the plates move together, they pivot to enable them to remain parallel and in contact with the ends of the can. The guide rails positively drive the crusher plates to maintain their faces parallel so the can will not slip out sideways. It will be noted that the guide rails are rigidly connected to the lower crusher plate extending at right angles thereto, that although the guide rails are slidable on the upper crusher plate the plate is always held at a fixed angle relative to the rails, being perpendicular thereto, the slots having enough length along the rails to prevent any rocking of the plate relative to the rails.

While a prefered embodiment of the invention has been shown and described modification thereof can be made by one skilled in the art without departing from the spirit of the invention.

I claim:

1. A crusher comprising a base, a handle, first single axis pivot means pivotally connecting the handle to the base constraining the handle to motion of rotation relative to the base about said single axis of said first single axis pivot means while preventing relative translation of the handle and base, an upper crusher plate, second single axis pivot means pivotally connecting said upper crusher plate to the handle providing a single axis of rotation that is stationary relative to both the handle and upper crusher plate and constraining said upper crusher plate to motion of rotation relative to said handle about said single axis of said second single axis pivot means while preventing relative translation of said upper crusher plate and said handle, a lower crusher plate, third single pivot axis means pivotally connecting said lower crusher plate to the base constraining said lower crusher plate to motion of rotation about said single pivot axis of said third single pivot axis means relative to the base, while preventing relative translation of said lower crusher plate and base, and positioning means maintaining said plates parallel to each other while the lower plate rotates relative to the base.

2. A crusher comprising a base, a handle, first single axis pivot means pivotally connecting the handle to the base constraining the handle to motion of rotation relative to the base about said single axis of said first single axis pivot means while preventing relative translation of the handle and base, an upper crusher plate, second single axis pivot means pivotally connecting said upper crusher plate to the handle constraining said upper crusher plate to motion of rotation relative to said handle about said single axis of said second single axis pivot means while preventing relative translation of said upper crusher plate and said handle, a lower crusher plate, third single pivot axis means pivotally connecting said lower crusher plate to the base constraining said lower crusher plate to motion of rotation about said single pivot axis of said third single pivot axis means relative to the base, while preventing relative translation of said lower crusher plate and base, and positioning means maintaining said plates parallel to each other, said positioning means including at least one guide rail secured to one of the plates by means preventing relative rotation therebetween while said one plate rotates relative to said base, said guide rail being slidable relative to the other plate.

3. Crusher according to claim 2 in which there are two guide rails, one at each side of the crusher, extending perpendicularly between the two plates, said guide rails being rotatable with said one plate relative to said base.

4. Crusher according to claim 2, or 3 in which the base is channel shaped, the lower crusher plate has outwardly extending pins pivotally received in holes in the sides of the base which is flexible enough that the sides can be sprung apart to receive the pins, the handle is fork shaped, having a pair of tines, said tines having inturned pins with key section ends received pivotally in key section holes in the sides of the base which is flexible enough that the sides can be sprung together to receive the inturned pins when their key section ends register with the key section holes, the key shaped holes being out of register with the key shaped ends of the pins when the handle is swung over the back of the channel, the handle having a shaft between said tines and the upper crusher plate having fingers snapped over the shaft and providing a bearing rotatably receiving the shaft.

5. Crusher according to claim 4, the parts thereof being made of plastics material and the handle and crusher plates being provided with ribs on their undersides and the tines of the handle being provided with ribs on their outsides, and the guide rails being of Tee section.

6. A can crusher comprising a base, a handle pivotally connected to the base, a first crusher plate pivotally connected to the handle, a second crusher plate pivotally connected to the base, and positioning means maintaining the plates parallel to each other at all times, said base being channel shaped and including a web and two sides each integrally connected to the web along one edge and free at the other edge, each side having a first hole therethrough at one end thereof and a second hole therethrough at the other end thereof, said second crusher plate having a pair of outwardly directed pins formed integral therewith, said second crusher plate being pivotally mounted on said base, as aforesaid, by said pins being disposed in said first holes of the sides of the base, the distance between the ends of the pins exceeding the distance between the adjacent faces of said sides of the base and the base being made of resilient material allowing the sides to be sprung apart to admit said pins into said first holes, said handle being fork-shaped including a pair of tines and a stem connected thereto, each tine having an inwardly directed pin formed integral therewith, said handle being pivotally connected to said base, as aforesaid, by said inwardly directed pins being disposed in said second holes of the sides of the base, the tines being outside of said sides of the base, the distance between the ends of said inwardly directed pins being less than the distance between the outer faces of said sides of the base, and the base being made of resilient material as aforesaid allowing the sides to be sprung together to admit said inwardly directed pins into said second holes, whereby the assembly is locked together by virtue of opposite directions of springing of said plates, to-wit, outwardly and inwardly, as required to separate said first crusher plate and handle respectively from said base.

7. A can crusher according to claim 6, said second holes being of key section, said inwardly directed pins having key section ends adapted to register with said second holes when said handle is positioned with its stem on the opposite side of said web from said sides and out of register with said second holes when said handle is positioned with its stem on the same side of said web as said sides, whereby said handle in the latter position is interlocked with said base preventing separation of the handle from the base which might otherwise occur by springing apart of said tines.

8. A can crusher according to claim 6, said handle having a shaft extending between said tines and formed integral therewith, said second crusher plate having resilient finger means formed integrally with one face of the second crusher plate, said second crusher plate being pivotally mounted on said handle, as aforesaid, by said resilient finger means being snapped around said shaft and providing a bearing means rotatably receiving said shaft.

9. A can crusher according to claim 7, said handle having a shaft extending between said tines and formed integral therewith, said second crusher plate having resilient finger means formed integrally with one face of the second crusher plate, said second crusher plate being pivotally mounted on said handle, as aforesaid, by said resilient finger means being snapped around said shaft and providing a bearing means rotatably receiving said shaft, whereby said base, handle, and plates are pivotally connected without need for separate connector means.

10. A crusher comprising a base, a handle, first single axis pivot means pivotally connecting the handle to the base constraining the handle to motion of rotation relative to the base about said single axis of said first single axis pivot means while preventing relative translation of the handle and base, an upper crusher plate, second single axis pivot means pivotally connecting said upper crusher plate to the handle constraining said upper crusher plate to motion of rotation relative to said handle about said single axis of said second single axis pivot means while preventing relative translation of said upper crusher plate and said handle, a lower crusher plate, third single pivot axis means pivotally connecting said lower crusher plate to the base constraining said lower crusher plate to motion of rotation about said single pivot axis of said third single pivot axis means relative to the base, while preventing relative translation of said lower crusher plate and base, and positioning means maintaining said plates parallel to each other, said upper plate having a pair of apertures therethrough, one at each side of said upper plate, said positioning means comprising a pair of guide rails, one at each side of the crusher, extending perpendicularly between the two plates, each guide rod extending slidably through one of said apertures in said upper plate, one end of each guide rail being press fitted in a socket in said lower plate, whereby said entire crusher is self-assembled without need for separate connection means.

11. Crusher according to claim 1, in which the base is channel shaped, the lower crusher plate has outwardly extending pins pivotally received in holes in the sides of the base which is flexible enough that the sides can be sprung apart to receive the pins, the handle is fork shaped, having a pair of tines, said tines having inturned pins with key section ends received pivotally in key section holes in the sides of the base which is flexible enough that the sides can be sprung together to receive the inturned pins when their key section ends register with the key section holes, the key shaped holes being out of register with the key shaped ends of the pins when the handle is swung over the back of the channel, the handle having a shaft between said tines and the upper crusher plate having fingers snapped over the shaft and providing a bearing rotatably receiving the shaft.

12. Crusher according to claim 11, the parts thereof being made of plastics material and the handle and crusher plates being provided with ribs on their undersides and the tines of the handle being provided with ribs on their outsides, and said positioning means comprising a pair of guide rails having Tee cross-sections.

* * * * *